US011932446B1

(12) United States Patent
Offman

(10) Patent No.: US 11,932,446 B1
(45) Date of Patent: Mar. 19, 2024

(54) FLUID FLOW CONTROLLER FOR BOTTLE

(71) Applicant: Henoch M. A. Offman, Bet Shemesh (IL)

(72) Inventor: Henoch M. A. Offman, Bet Shemesh (IL)

( * ) Notice: Subject to any disclaimer, the term of this patent is extended or adjusted under 35 U.S.C. 154(b) by 0 days.

(21) Appl. No.: 17/969,749

(22) Filed: Oct. 20, 2022

(51) Int. Cl.
*B65D 1/02* (2006.01)
*B65D 23/04* (2006.01)
*B65D 41/04* (2006.01)

(52) U.S. Cl.
CPC ..... *B65D 23/04* (2013.01); *B65D 1/0246* (2013.01); *B65D 41/04* (2013.01)

(58) Field of Classification Search
CPC ..... B65D 23/04; B65D 1/0246; B65D 41/04
See application file for complete search history.

(56) References Cited

U.S. PATENT DOCUMENTS 3,173,566 A * 3/1965 Talbert ..... B65D 77/283 215/229
4,938,395 A * 7/1990 Jamieson ..... B65D 47/06 222/545
4,967,922 A * 11/1990 Alder ..... B65D 47/06 222/481
5,326,003 A * 7/1994 Kitto ..... A47G 21/18 222/481.5
5,449,098 A * 9/1995 Offman ..... B67D 3/0019 222/481.5
11,745,913 B1 * 9/2023 Spence ..... B65D 81/3227 215/6
2009/0071926 A1 * 3/2009 Berkovitch ..... A61J 9/04 215/11.4
2013/0334161 A1 * 12/2013 Meager ..... B65D 47/32 215/386

* cited by examiner

*Primary Examiner* — Frederick C Nicolas

(57) ABSTRACT

A bottle for causing a steady discharge of fluid when inverted that includes a bottle with a small hole in its neck, a disk retainer rim with a center hole and a multiplicity of holes through its annular section, a hollow barrel-like reservoir with a hole at its upper end when in the inverted position and a hole in its side, an air inlet tube perpendicular to the axis of the reservoir, with one end inserted into the side hole of the reservoir and protruding into the inside of the reservoir, the other end of which is extended through the side hole in the neck of the bottle, and a tube axially and angularly inserted into the hole in the upper end of the reservoir and extending to the top and side of the bottle when in the inverted position.

6 Claims, 6 Drawing Sheets

FLUID FLOW CONTROLLER FOR BOTTLE

FIELD OF THE INVENTION

The invention relates to an apparatus which is attached inside a bottle, container or can. With the use of the present invention, when the bottle is inverted the fluid inside the bottle flows out of the bottle smoothly.

BACKGROUND ART

When a bottle is inverted the fluid inside it flows out irregularly. This is a result of air alternately entering the bottle and fluid exiting the bottle at the name of the bottle. This results in an irregular and uneven flow. The present invention provides a means for air to enter the bottle through an opening in the side of the bottle, thereby avoiding the inward flow of the air interfering with exiting fluid flow from the neck of the bottle. This provides for a smooth for a flow of fluid from the bottle. An internal reservoir avoids leakage of the fluid when the bottle is inverted.

In general, prior inventions have not combined the elements of a reservoir in the neck of a bottle with an air inlet (venting) hole in the side of the neck. In Jamieson, U.S. Pat. No. 4,938,395, a vent hole is placed in the side of a bottle. Alder, U.S. Pat. No. 4,967,922, discloses a bleeder valve mechanisms inside a bottle to control fluid flow. Talbert, U.S. Pat. No. 3,173,566, discloses a drinking straw mechanism to control flow, combined with a side vent.

Offman, U.S. Pat. No. 5,449,098 (a previous invention by this inventor), discloses the element of a reservoir in the neck of a bottle with an air inlet (venting) hole in the side of the neck. However, according to this prior art, the air inlet hole must be pointed upward to avoid leakage from the reservoir.

BRIEF SUMMARY OF THE INVENTION

The object of the invention is to facilitate the smooth flow of fluid from an inverted bottle regardless of the direction in which the air inlet (venting) hole is pointed.

Another object of the invention is to prevent leaking of liquid from an inverted bottle with smooth flow of fluid, when drinking or pouring from the bottle.

DESCRIPTION OF THE DRAWINGS

The intention of the drawings attached to the application is not to limit the scope of the invention and its application.

The drawings are intended only to illustrate the invention and they constitute only one of its many possible implementations.

DETAILED DESCRIPTION OF THE INVENTION

Figure 1:
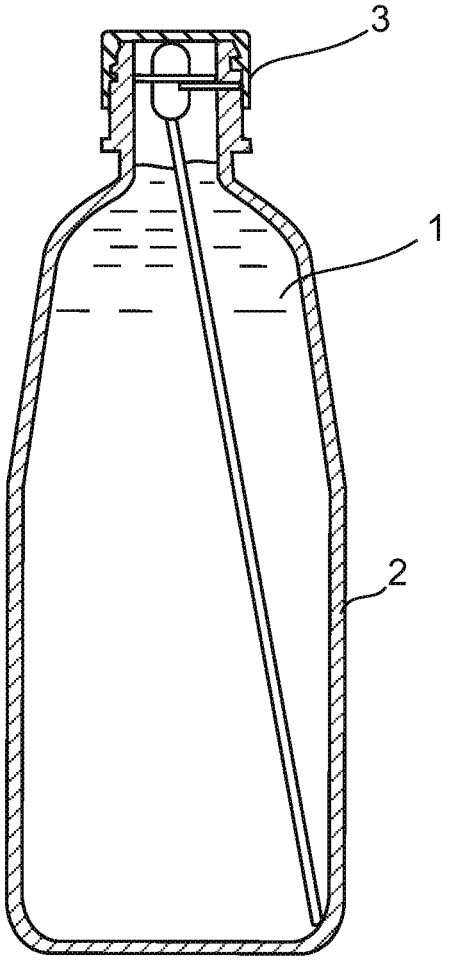
FIG. 1 is a cross section of a closed bottle in an upright position, containing the bottle fluid flow controller, and the cap for sealing the top of the bottle and air inlet.

Typically in the use of the invention, as in FIG. 1, a bottle 2 in an upright position is filled with a fluid 1 and closed with a cap 3. When the bottle is inverted, with the cap 3 removed as in FIG. 2, only the fluid previously in the tube flows down the tube 10 into the reservoir 7. The fluid fills the top part of the reservoir 23 until its level reaches the bottom of the air inlet hole/tube 12, 19 which is inserted into the middle of the side of the reservoir. An extension 29 of the air inlet hole/tube 12, 19 protrude into the inside of the reservoir 7. In use, the air inlet hole/tube 12, 19 is allowed to be pointed in any direction, upward, down, right, left, or diagonal and no leakage from the reservoir 7 will occur because the walls of the extension 29 block the liquid in the reservoir 7 and stop the liquid from leaking out of the reservoir 7.

Figure 4:
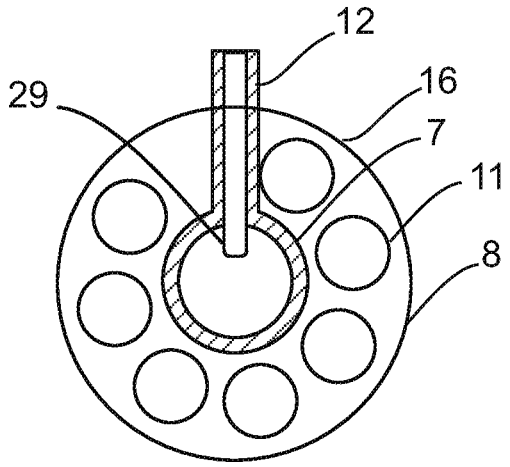
FIG. 4 is a section of the bottle flow controller perpendicular to the longitudinal axis of the reservoir.
Figure 5:
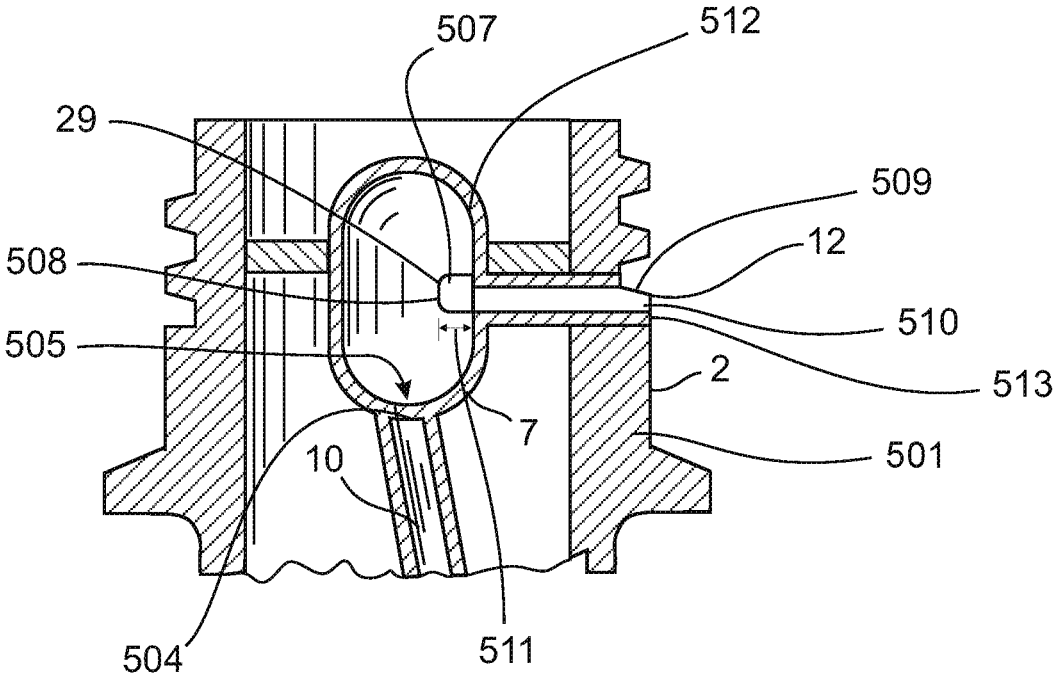
FIG. 5 is a section of the bottle flow controller parallel to the longitudinal axis of the reservoir, placed into the neck of the bottle.

The reservoir 7 is affixed to the inside opening of a flat disk shaped rim 8 as in FIG. 4. Multiplicities of holes, 11, are located in the annular portion of the rim, through which the flowed flows upon discharging from the inverted bottle. The outer circumference 16 of the rim is affixed to the inside wall of the bottle neck. FIG. 5 is a section through the bottle.

Figure 6:
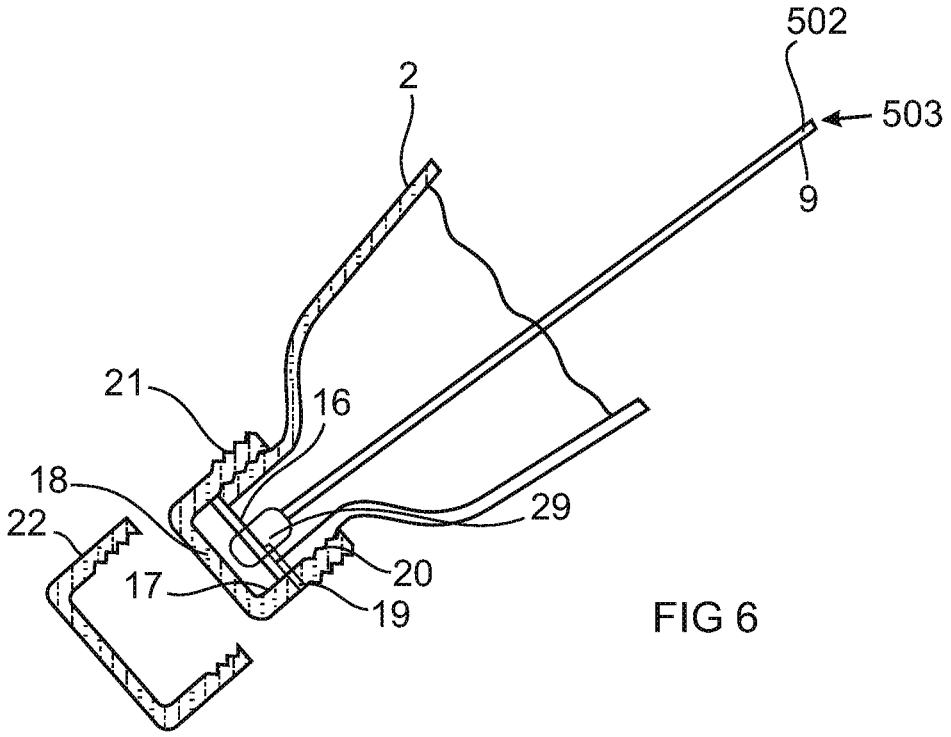
FIG. 6 is a section of the bottle flow controller, showing the rim attached to an opened top cap, together with a second cap.
Figure 7:
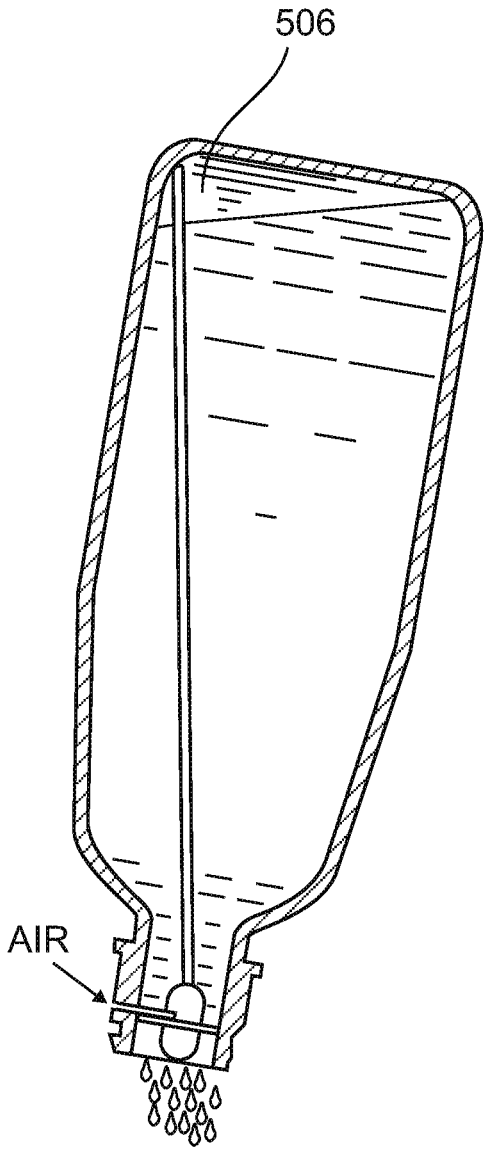
FIG. 7 is a cross section of an open bottle in an inverted position, containing the bottle flow controller, with a small amount of fluid discharged from the bottle.
Figure 8:
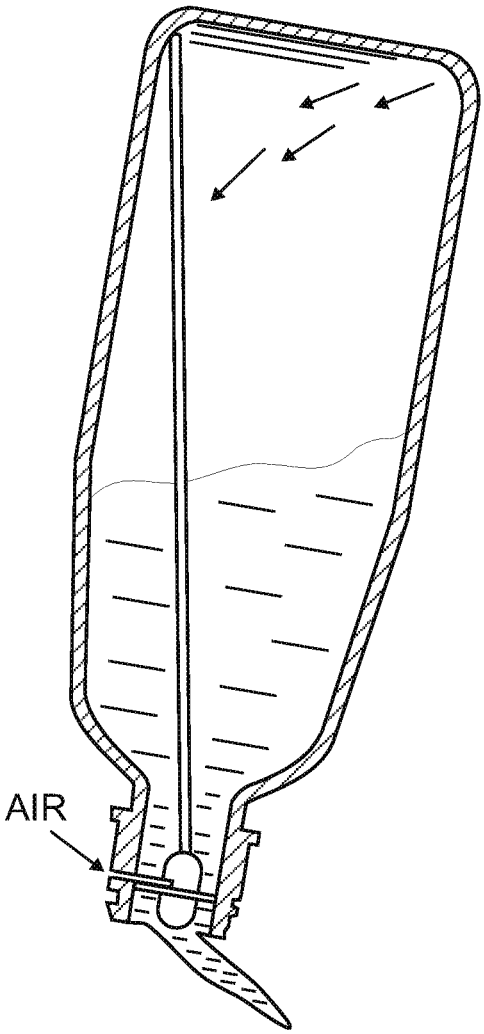
FIG. 8 is a cross section of an open bottle in an inverted position, containing the bottle flow controller, with approximately half of the fluid discharged from the bottle.
Figure 9:
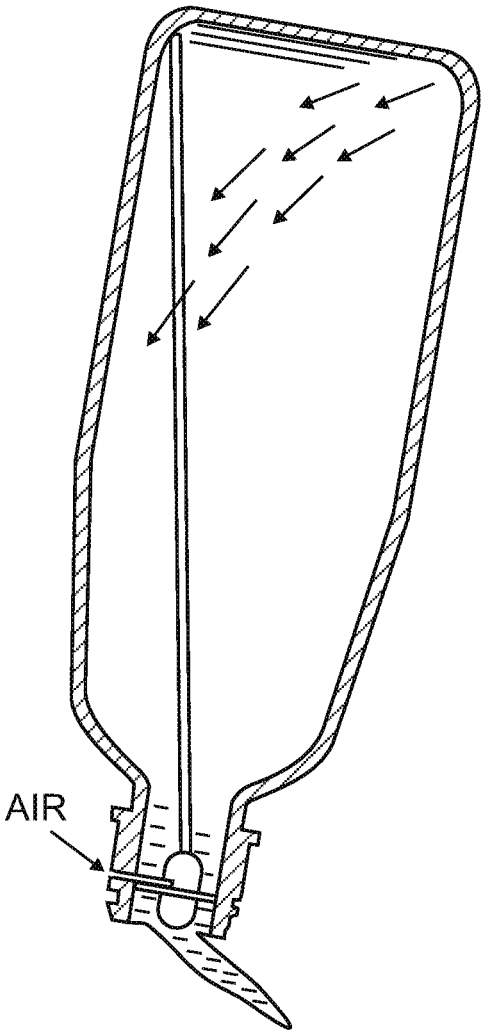
FIG. 9 is a cross section of an open bottle in an inverted position, containing the bottle flow controller, with most of the fluid discharged from the bottle.

In another embodiment of the invention, as in FIG. 6, the outer of the circumference of the rim 16 is attached to the inner wall of a cap 17 which is open on its top 18 and in which an air inlet hole/tube 19 is located in its side. The inside of the bottom of the cap is threaded 20 such that it can be screwed onto the open end of a bottle 2. The top outside of the cap 21 is threaded such that a cap 22 can be screwed on the close the bottle 2.

Figure 11:
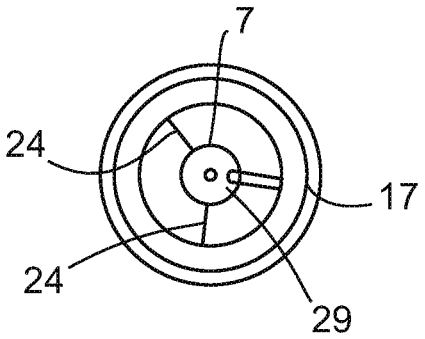
FIG. 11 is a top view of the top of a bottle sealed with a cap held by 2 supports.
Figure 12:
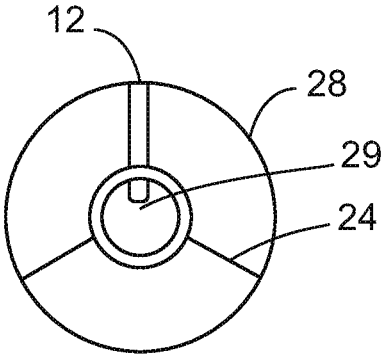
FIG. 12 is a top view of the tube-reservoir assembly.

In other embodiment, as in FIG. 11, the reservoir 7 may be supported by two (2) supports 24, which are attached to the inner surface of the cap 17 or, as in FIG. 12, to the inner surface 28 of the neck of the bottle 2.

Figure 2:
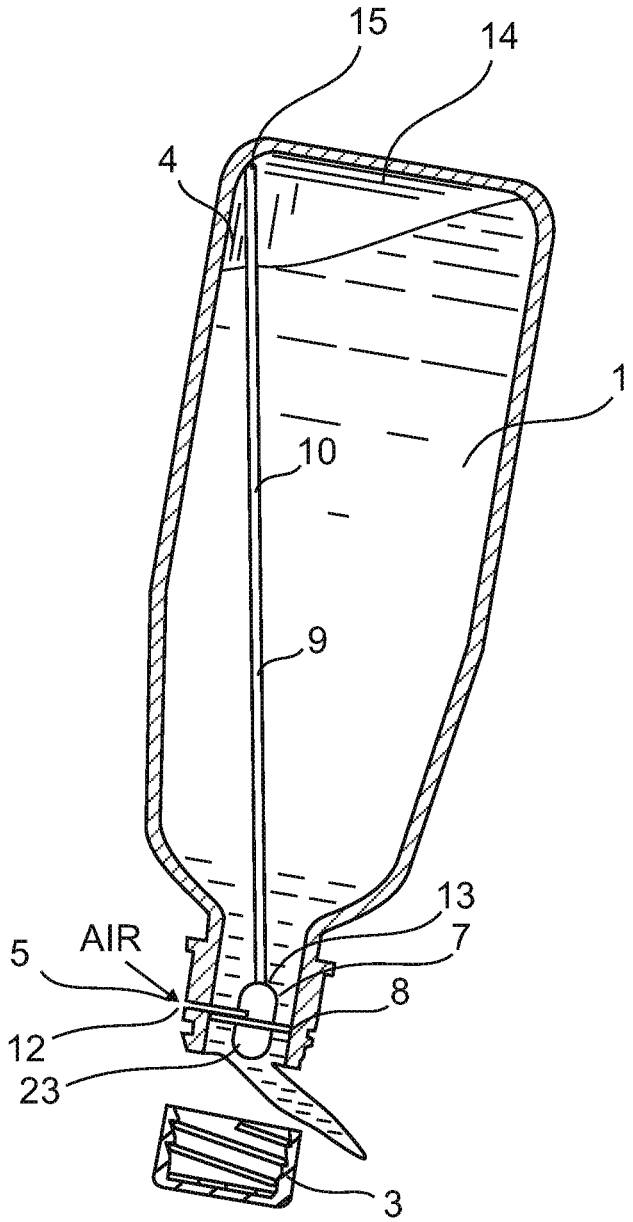
FIG. 2 is a cross section of an open bottle in an inverted position, containing the bottle fluid flow controller.
Figure 3:
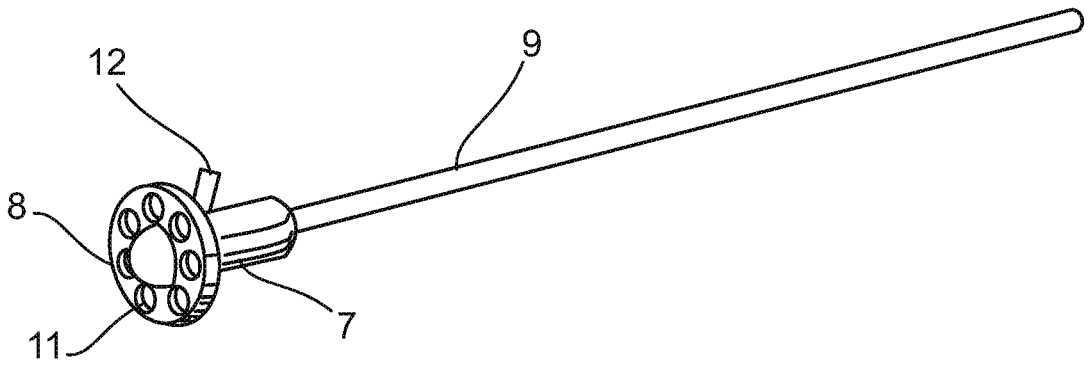
FIG. 3 is a perspective view of the bottle flow controller, without a surrounding bottle.

As seen in FIG. 2, as a result of the displacement of fluid from the bottle, a partial vacuum is created in the air cavity above the fluid 4. Air 5 is forced into the air inlet hole/tube 12 and flows through the unfilled end of the reservoir 13 of the reservoir 7.

The air then flows 10 up the tube 9 to the air cavity above the fluid 4. This air creates a pressure on the top of the fluid 14. The tube 9 is affixed to the end of the reservoir 7, at an angle, such that when the bottle is inverted, the open end of the tube 15 is located at the corner which contains air 14 thereby allowing the air 5 from outside the bottle 2 to combine with the air in the corner 14. Thus, from the beginning of use of the bottle 2, none of the liquid can flow out of the bottle through the tube 9. Only the small amount of the liquid which had already been within the tube when it was standing upright will now flow down to the top of the reservoir 23 and remain there, below the level of the air inlet hole/tube 12 allowing a free passage for incoming air.

The top of the reservoir 23 retains a small amount of liquid which is kept from leaking through the air inlet hole/tube 12. The top of the reservoir 23 is large enough to contain the entire amount of the liquid which had been located in the tube 9.

The lower part of the reservoir 13 should be as large as the top part of the reservoir 23 in order to contain the full amount of which will flow into it when flow is stopped, due to stoppage of drinking and holding the container upright. The liquid which was contained in the top part of the reservoir 23 will not leak outside the bottle through the air hole/tube 12 but rather will be contained in the bottom part of the reservoir 13 and then slowly continue flowing down through the tube 9 to the bottom of the bottle. The top 23 and the lower part 13 of the reservoir need be of equal size. This is accomplished by placing the air inlet hole/tube 12 in the exact middle of the reservoir 7. The present invention results in a steady strong fluid flow from a narrow neck inverted bottle, without a resulting gurgling and intermittent flow.

Figure 10:
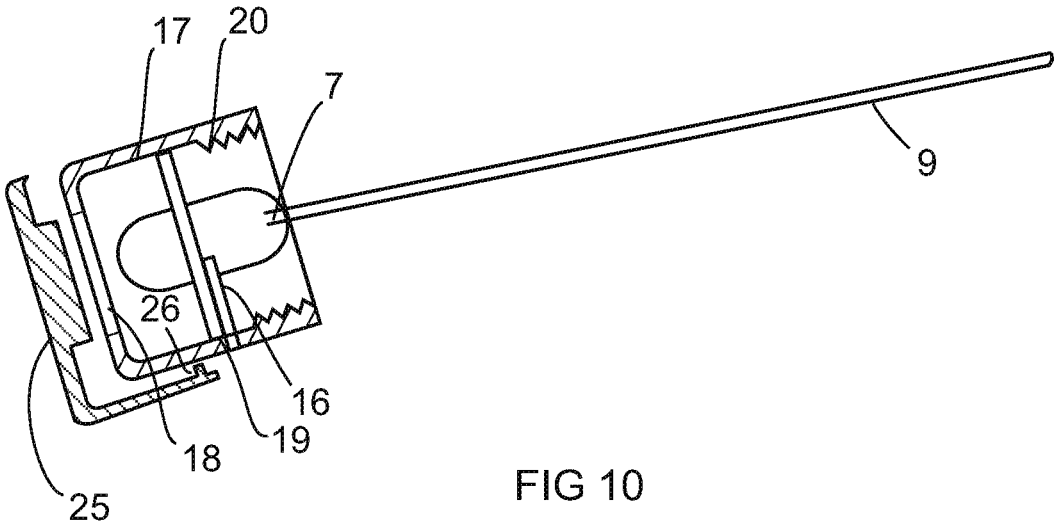
FIG. 10 is a cross section of a tube-reservoir assembly which is affixed to a cap, showing another cap for sealing the opening in the top of the first cap.
Figure 13:
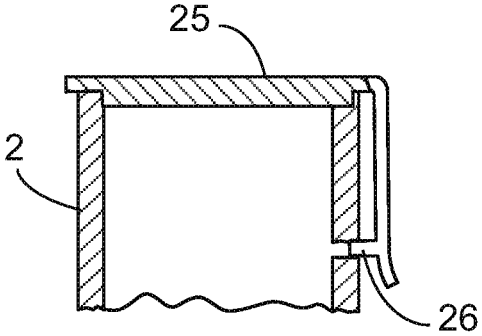
FIG. 13 is a cross section showing a cap for sealing the top of the bottle.

As shown in FIG. 10, an assembly consisting of the reservoir 7 and tube 9 may be attached 17 to the inner walls of a cap 16 which is open at the top 18. The lower inner walls of the cap are threaded 20 and affixed to the neck of the bottle, which is threaded at the top. An outer cap 22 is threaded over the cap 21, as in FIG. 6. The outer cap 25 may snap in place as in FIG. 10, which covers the air inlet hole/tube 19 via a tab. As shown in FIG. 13, a plastic cap 25 with a tab 26 may be used to seal the opening at the top of the bottle 2.

We can summarize the inventions in other words as follows A bottle (2) with a mechanism for enabling a steady discharge of liquids (1) from the bottle when the bottle is in an inverted position. The mechanism includes.

(a) a reservoir (7) that is attached to the inner wall (17) of the neck (501) of the bottle.

(b) a vertical tube (9) that has a bottom end (502) with a bottom opening (503) and a top end (504) with a top opening (505). The bottom end of the vertical tube is positioned in the bottom part (506) of the bottle and the top end of the vertical tube is connected to the reservoir in a way that enables air to flow from the reservoir to the bottle through the vertical tube.

(c) an horizontal tube (19) that has a first end (507) with a first opening (508) and a second end (509) with a second opening (510). The first end of the horizontal tube is positioned inside the reservoir in such a way that the first opening is in a distance (511) from the inner wall (512) of the reservoir. The second end of the horizontal tube is connected to a hole (513) on the neck of the bottle in a way that enables air to flow from outside the bottle into the reservoir through the horizontal tube.

The distance between the first opening of the horizontal tube and the inner wall of the reservoir makes it difficult for liquids in the reservoir that slide on the inner wall of the reservoir while the bottle is rotated to flow out through the first opening of the horizontal tube.

What is claimed is:

1. A bottle fluid flow controller for causing a steady discharge of fluid from a bottle, container or can, in an inverted position, comprising:

(a) the bottle wherein the bottle has a hole in a neck of the bottle and outside threads on an upper part of the neck;

(b) a flat disk shaped rim having a center hole and a multiplicity of holes through an annular section, an outer circumference of which is affixed to an inner wall of the neck of the bottle;

(c) a reservoir having a hole at an upper end of the reservoir when in the inverted position and a hole in a side of the reservoir, an outer longitudinal surface being affixed to the inner circumference of the center hole of the flat disk shaped rim;

(d) an air inlet tube, perpendicular to an axis of the reservoir, with one end inserted into a side hole on the reservoir and protruding into the reservoir, the other end of which is extended through a side hole on the neck of the bottle;

(e) a tube axially and angularly inserted into the hole in the upper end of the reservoir and extending to the top and side of the bottle when in the inverted position.

2. The bottle fluid flow controller of claim 1 wherein said outer circumference of said flat disk shaped rim is affixed to an inner wall of a cap that is open in a top part of the cap and in a bottom part of the cap and has a hole in a side part of the can; said cap having inside threads that are threaded over said outside threads at said top of said bottle, and one end of the air inlet tube extends through the hole in the side of the cap and the other end is inserted in the hole in said reservoir and extends inside the reservoir.

3. The bottle fluid flow controller of claim 2 wherein said top part of said cap has outside threads and a screw cap is screwed onto a top end of the cap to contain the fluid.

4. The bottle fluid flow controller of claim 2 wherein a plastic cap is fitted into opening of said cap and a tab attached to the plastic cap is designed to be inserted into a side hole on the cap.

5. The bottle fluid flow controller of claim 1 wherein a multiplicity of pins extend perpendicular and radially from longitudinal walls of reservoir and affixed to said inner wall of the neck of the bottle.

6. A bottle with a mechanism for enabling a steady discharge of liquids from the bottle when the bottle is in an inverted position, said mechanism comprising:

a reservoir that is attached to an inner wall of a neck of the bottle:

a vertical tube that has a bottom end with a bottom opening and a top end with a top opening, wherein the bottom end of the vertical tube is positioned in a bottom part of the bottle and the top end of the vertical tube is connected to the reservoir in a way that enables air to flow from the reservoir to the bottle through the vertical tube, a horizontal tube that has a first end with a first opening and a second end with a second opening; wherein the first end of the horizontal tube is positioned inside the reservoir in such a way that the first opening is in a distance from the inner wall of the reservoir, and wherein the second end of the horizontal tube is connected to a hole on the neck of the bottle in a way that enables air to flow from outside the bottle into the reservoir through the horizontal tube; wherein a distance between the first opening of the horizontal tube and the inner wall of the reservoir is designed to prevent liquids in the reservoir that slide on the inner wall of the reservoir while the bottle is rotated to flow out through the first opening of the horizontal tube.

* * * * *